US009640123B2

(12) United States Patent
Liu et al.

(10) Patent No.: US 9,640,123 B2
(45) Date of Patent: May 2, 2017

(54) DISPLAY DRIVING METHOD USING OVERLAPPING SCAN MODE TO REDUCE COUPLING EFFECT

(71) Applicant: BEIJING BOE OPTOELECTRONICS TECHNOLOGY CO., LTD., Beijing (CN)

(72) Inventors: Rui Liu, Beijing (CN); Hao Zhang, Bejing (CN); Xue Dong, Beijing (CN); Hyungkyu Kim, Beijing (CN); Xiaobo Xie, Beijing (CN)

(73) Assignee: Beijing BOE Optoelectronics Technology Co., Ltd., Beijing (CN)

( * ) Notice: Subject to any disclaimer, the term of this patent is extended or adjusted under 35 U.S.C. 154(b) by 64 days.

(21) Appl. No.: 14/137,947

(22) Filed: Dec. 20, 2013

(65) Prior Publication Data

US 2014/0176527 A1 Jun. 26, 2014

(30) Foreign Application Priority Data

Dec. 21, 2012 (CN) ..... 2012 1 056412

(51) Int. Cl.
*G09G 3/36* (2006.01)

(52) U.S. Cl.
CPC ..... *G09G 3/3648* (2013.01); *G09G 3/3677* (2013.01); *G09G 2310/0205* (2013.01);
(Continued)

(58) Field of Classification Search
CPC .. G09G 3/3611; G09G 3/3648; G09G 3/3666; G09G 3/3674; G09G 3/3677;
(Continued)

(56) References Cited

U.S. PATENT DOCUMENTS 7,042,426 B2 * 5/2006 Shin ..... 345/76
7,679,596 B2 * 3/2010 Kim ..... G09G 3/3648 345/204

(Continued)

FOREIGN PATENT DOCUMENTS

CN 101097368 A 1/2008
CN 101135825 A 3/2008

(Continued)

OTHER PUBLICATIONS

Office Action for corresponding Chinese Patent Application No. 201210564612.4, 6 pages, (May 19, 2014).

(Continued)

*Primary Examiner* — Viet Pham
*Assistant Examiner* — Darlene M Ritchie
(74) *Attorney, Agent, or Firm* — Blakely, Sokoloff, Taylor & Zafman LLP

(57) ABSTRACT

The embodiment of the present invention provides a display driving method which can reduce the coupling effect due to the rapid changes of the voltage on the gate line and improve stability of display. The display driving method uses an overlapping scan mode, wherein every two rows of pixel units have two gate lines, the two gate lines drive the pixel units connected thereto respectively, each gate line group including N pairs of adjacent two gate lines, N being a natural number, said driving method comprising: providing a switching voltage signal to the odd gate lines in the gate line group sequentially; and providing a switching voltage signal to the even gate lines in the gate line group sequentially; wherein when the switching voltage signal on the odd gate lines is in the falling edge, the switching voltage signal on the even gate lines is in the rising edge.

6 Claims, 5 Drawing Sheets

(52) U.S. Cl.
CPC ..... *G09G 2310/0224* (2013.01); *G09G 2320/0219* (2013.01)

(58) Field of Classification Search
CPC ..... G09G 2310/02; G09G 2310/0202; G09G 2310/0205; G09G 2310/0208; G09G 3/3614; G09G 3/2022; G09G 3/3688; G09G 3/3233; G09G 3/3266; G09G 3/3406; G09G 3/36; G09G 2300/0426; G09G 2300/0861; G09G 2300/0465; G09G 2310/0224; G09G 2310/0267; G09G 2310/061; G09G 2320/0219; G02F 1/136286; G02F 2201/40; H01L 27/124
See application file for complete search history.

(56) References Cited

U.S. PATENT DOCUMENTS 7,839,374 B2 * 11/2010 Kim et al. ..... 345/100
7,847,765 B2 * 12/2010 Park et al. ..... 345/82
8,179,350 B2 * 5/2012 Park ..... G02F 1/1368 345/87
8,619,019 B2 * 12/2013 Lee et al. ..... 345/103
2001/0046001 A1 * 11/2001 Yamaguchi ..... G02F 1/136213 349/43
2003/0043104 A1 * 3/2003 Lee et al. ..... 345/92
2004/0125046 A1 * 7/2004 Yamazaki et al. ..... 345/1.3
2004/0183768 A1 * 9/2004 Yamato et al. ..... 345/98
2004/0239603 A1 * 12/2004 Toriumi et al. ..... 345/89
2005/0110750 A1 * 5/2005 Park ..... 345/156
2006/0139281 A1 * 6/2006 Park ..... 345/96
2006/0145998 A1 * 7/2006 Cho et al. ..... 345/100
2006/0290644 A1 * 12/2006 Kim ..... 345/100
2007/0052658 A1 * 3/2007 Kim ..... 345/100
2008/0180372 A1 * 7/2008 Kim ..... G09G 3/3677 345/87
2009/0195489 A1 * 8/2009 Hung ..... G02F 1/136286 345/92
2009/0213109 A1 * 8/2009 Lai ..... G09G 3/3659 345/214
2009/0231311 A1 * 9/2009 Shin ..... 345/205
2009/0278776 A1 * 11/2009 Pai et al. ..... 345/87
2010/0328198 A1 * 12/2010 Tsubata ..... G09G 3/3659 345/87
2011/0043498 A1 * 2/2011 Tsubata ..... G02F 1/13624 345/204
2011/0102414 A1 * 5/2011 Lin ..... G09G 3/3648 345/213
2011/0115998 A1 * 5/2011 Liao ..... G02F 1/136213 349/38
2011/0157243 A1 * 6/2011 Chen ..... G09G 3/3659 345/690
2011/0169793 A1 * 7/2011 Chen et al. ..... 345/205
2011/0273421 A1 * 11/2011 Chung ..... 345/211
2011/0310035 A1 * 12/2011 Kim ..... G06F 3/044 345/173
2012/0075277 A1 * 3/2012 Hirayama ..... G09G 3/3614 345/209
2012/0081347 A1 * 4/2012 Kim ..... 345/211
2012/0086682 A1 * 4/2012 Shi ..... G09G 3/3677 345/204
2012/0146964 A1 * 6/2012 Kim ..... G09G 3/3688 345/204
2012/0293762 A1 11/2012 Shin et al.
2013/0155034 A1 * 6/2013 Nakayama ..... G09F 9/35 345/204
2013/0314392 A1 * 11/2013 Kim ..... G09G 3/20 345/212

FOREIGN PATENT DOCUMENTS

CN 102446498 A 5/2012
KR 10-2008-0002570 A 1/2008
KR 10-2009-0055411 A 6/2009
TW 201220287 A1 5/2012
WO WO 2012/161000 A1 11/2012

OTHER PUBLICATIONS

Office Action for corresponding Chinese Patent Application No. 201210564612.4, 6 pages, (Dec. 26, 2014).
Office Action for corresponding Korean Patent Application No. 10-2013-0160213, 6 pages (including English translation), (Oct. 30, 2014).
European Patent Office Communication enclosing Partial European Search Report for corresponding European Patent Application No. 13198284.5, (Feb. 20, 2015).
European Patent Office Communication enclosing Office Action for corresponding European Patent Application No. 13198284.5, 10 pp., (Mar. 31, 2016).

* cited by examiner

DISPLAY DRIVING METHOD USING OVERLAPPING SCAN MODE TO REDUCE COUPLING EFFECT

FIELD OF THE INVENTION

The present invention relates to the field of display, particularly to a display driving method.

BACKGROUND OF THE INVENTION

With the continuous development of electronic technology, LCD displays have been widely used in various fields. A thin film transistor (TFT) array substrate is an important part of a liquid crystal display. Most TFT array substrate includes a base, common electrode lines, gate lines and data lines and other structures, wherein the gate lines are disposed between the two rows of sub-pixels, the data lines are disposed between the two columns of sub-pixels, the crossing regions of the gate lines and the data lines form the pixel units; the common electrode lines are also disposed between two rows of sub-pixels.

A driving method shown in FIG. 1 uses the overlapping scan driving modes, that is the gate pulse signal are overlapped therebetween. FIG. 1 shows the data voltage signal on the data lines and the switching voltage signals on four gate lines G1, G2, G3, and G4, wherein the switching voltage signal may be a pulse signal. As for the switching voltage signal on the gate line G2, in the first half of the switching voltage signal, the data voltage signal corresponding to the last gate line is written, in the second half of the switching voltage signal, the data voltage signal corresponding to the current gate line is written. During actual driving, firstly the thin-film transistor is turned on and the data voltage signal is provided to the pixel unit, if the switching voltage signals on the four gate lines G1, G2, G3 and G4 control the thin film transistors to be turned on in order. During changing of the gate voltages, there are certain periods wherein the switching voltage signals on two adjacent gate lines are both in high level (i.e., TFT is turned on), thus the magnetic field generated by the changing voltage on two gates lines are superimposed, leading to a strong coupling effect. In addition, due to the rapid changes of the voltage on the gate line, while the voltage on the common electrode line parallel to the gate line is usually constant, the enhanced coupling effect will further lead to instability of the common electrode voltage VCOM, affecting the display quality of the screen.

SUMMARY OF THE INVENTION

The embodiment of the present invention provides a display driving method, which can reduce the coupling effect due to the rapid changes of the voltage on the gate line and improve stability of display.

The present application provides a display driving method using overlapping scan mode, every two rows of pixel units have two gate lines to control the two rows of pixel units respectively, the two gate lines drive the pixel units connected thereto respectively, each gate line group including N pairs of adjacent two gate lines, N being a natural number, said driving method comprising:

providing a switching voltage signal to the odd gate lines in the gate line group sequentially; and providing a switching voltage signal to the even gate lines in the gate line group sequentially;

wherein when the switching voltage signal on the odd gate lines is in the falling edge, the switching voltage signal on the even gate lines is in the rising edge.

Further, when N=1, each gate line group includes four gate lines.

The gate line group comprises a first gate line, a second gate line, a third gate line and the fourth gate line, the display driving method comprising:

providing a switching voltage signal to the first gate line, and providing a first data voltage signal to the corresponding first row of pixel units;

providing a switching voltage signal to the third gate line, and providing a third data voltage signal to the corresponding third row of pixel units;

providing a switching voltage signal to the second gate line, and providing a second data voltage signal to the corresponding second row of pixel units;

providing a switching voltage signal to the fourth gate line, and providing a fourth data voltage signal to the corresponding fourth row of pixel units.

Further, providing a data voltage signal to the corresponding first row of pixel units comprising: providing a first data voltage signal to the corresponding first row of pixel units in the second half of the switching voltage signal;

providing a data voltage signal to the corresponding third row of pixel units comprising: transmit the first data voltage signal of the first row of pixel units to the corresponding third row of pixel units in the first half of the switching voltage signal, and transmit the third data voltage signal to the third row of pixel units in the second half of the switching voltage signal;

providing a data voltage signal to the second row of pixel units comprising: transmit the third data voltage signal of the third row of pixel units to the corresponding second row of pixel units in the first half of the switching voltage signal, and transmit the second data voltage signal to the second row of pixel units in the second half of the switching voltage signal;

providing a data voltage signal to the fourth row of pixel units comprising: transmit the second data voltage signal of the first row of pixel units to the corresponding fourth row of pixel units in the first half of the switching voltage signal, and transmit the fourth data voltage signal to the fourth row of pixel units in the second half of the switching voltage signal.

Further, when N=2, each of the gate line group including eight gate lines.

Further, the gate line group comprises a first gate line, a second gate line, a third gate line, a fourth gate line, a fifth gate line, a sixth gate line, a seventh gate line and a eighth gate line, the driving method comprising:

providing switching voltage signals to the first gate line, and providing a data voltage signal to the corresponding first row of pixel units;

providing switching voltage signals to the third gate line, and providing a data voltage signal to the corresponding third row of pixel units;

providing switching voltage signals to the fifth gate line, and providing a data voltage signal to the corresponding fifth row of pixel units;

providing switching voltage signals to the seventh gate line, and providing a data voltage signal to the corresponding seventh row of pixel units;

providing switching voltage signals to the second gate line, and providing a data voltage signal to the corresponding second row of pixel units;

providing switching voltage signals to the fourth gate line, and providing a data voltage signal to the corresponding fourth row of pixel units;

providing switching voltage signals to the sixth gate line, and providing a data voltage signal to the corresponding sixth row of pixel units;

providing switching voltage signals to the eighth gate line, and providing a data voltage signal to the corresponding eighth row of pixel units.

Further, providing a data voltage signal to the corresponding first row of pixel units comprising: providing a first data voltage signal to the corresponding first row of pixel units in the last quarter of the switching voltage signal;

providing a data voltage signal to the corresponding third row of pixel units comprising: providing the first data voltage signal to a corresponding third row of pixel units in the third quarter of the switching voltage signal, and providing the third data voltage signal to the corresponding third row of pixel units in the last quarter of the switching voltage signal;

providing a data voltage signal to the corresponding fifth row of pixel units comprising: providing the first data voltage signal to a corresponding fifth row of pixel units in the second quarter of the switching voltage signal, providing the third data voltage signal to the corresponding fifth row of pixel units in the third quarter of the switching voltage signal, and providing the fifth data voltage signal to the corresponding fifth row of pixel units in the last quarter of the switching voltage signal;

providing a data voltage signal to the corresponding seventh row of pixel units comprising: providing the first data voltage signal to a corresponding seventh row of pixel units in the first quarter of the switching voltage signal, providing the third data voltage signal to the corresponding seventh row of pixel units in the second quarter of the switching voltage signal, providing the fifth data voltage signal to the corresponding seventh row of pixel units in the third quarter of the switching voltage signal, and providing the seventh data voltage signal to the corresponding seventh row of pixel units in the last quarter of the switching voltage signal;

providing a data voltage signal to the corresponding second row of pixel units comprising: providing the third data voltage signal to a corresponding second row of pixel units in the first quarter of the switching voltage signal, providing the fifth data voltage signal to the corresponding second row of pixel units in the second quarter of the switching voltage signal, providing the seventh data voltage signal to the corresponding second row of pixel units in the third quarter of the switching voltage signal, and providing the second data voltage signal to the corresponding second row of pixel units in the last quarter of the switching voltage signal;

providing a data voltage signal to the corresponding fourth row of pixel units comprising: providing the fifth data voltage signal to a corresponding fourth row of pixel units in the first quarter of the switching voltage signal, providing the seventh data voltage signal to the corresponding fourth row of pixel units in the second quarter of the switching voltage signal, providing the second data voltage signal to the corresponding fourth row of pixel units in the third quarter of the switching voltage signal, and providing the fourth data voltage signal to the corresponding fourth row of pixel units in the last quarter of the switching voltage signal;

providing a data voltage signal to the corresponding sixth row of pixel units comprising: providing the seventh data voltage signal to a corresponding sixth row of pixel units in the first quarter of the switching voltage signal, providing the second data voltage signal to the corresponding sixth row of pixel units in the second quarter of the switching voltage signal, providing the fourth data voltage signal to the corresponding sixth row of pixel units in the third quarter of the switching voltage signal, and providing the sixth data voltage signal to the corresponding sixth row of pixel units in the last quarter of the switching voltage signal;

providing a data voltage signal to the corresponding eighth row of pixel units comprising: providing the second data voltage signal to a corresponding eighth row of pixel units in the first quarter of the switching voltage signal, providing the fourth data voltage signal to the corresponding eighth row of pixel units in the second quarter of the switching voltage signal, providing the sixth data voltage signal to the corresponding eighth row of pixel units in the third quarter of the switching voltage signal, and providing the eighth data voltage signal to the corresponding eighth row of pixel units in the last quarter of the switching voltage signal.

Furthermore, while providing switching voltage signals sequentially to the odd gate lines in the gate line group, the method further comprising:

storing the switching voltage signal of the even gate lines in the random access memory of the timing controller;

and before providing the switching voltage signals sequentially to the even gate lines in the gate line group, the method further comprising:

reading from the random access memory of the timing controller the switching voltage signals of the even gate lines.

According to the display driving method of an embodiment of the present invention, all the gate lines are divided into several groups, when scanning the display, firstly the odd gate lines in the first gate line group are provided with switching voltage signals sequentially, then the even gate lines in the first gate line group are provided with switching voltage signals sequentially. In this way, the switching voltage signals on the adjacent two gate lines are set in a manner that one is in rising edge while the other is in falling edge, the magnetic field generated by voltage changes in the two adjacent gate lines are canceled by each other, which improves the stability of display.

BRIEF DESCRIPTION OF THE DRAWINGS

In order to illustrate the embodiments of the present invention or the prior art more clearly, the drawings to be referenced in describing the embodiments will be described in brief. Obviously, the drawings to be described hereinafter is merely some embodiments of the present invention; for persons of ordinary skill in the art, without the premise of creative effort, other drawings can be obtained according to these figures.

DETAILED DESCRIPTION OF THE EMBODIMENTS

Embodiments of the present invention provides a display driving method which can reduce the coupling phenomenon due to rapid changes in voltage on the gate lines, improving the stability of display.

In the following description, for illustration rather than limitation, specific details such as system structures, interfaces, techniques are proposed for a thorough understanding of the present invention. However, other embodiments of the present invention without these specific details are apparent to those skilled in the art. In other instances, detailed description to the well-known devices, circuits, and methods is omitted in order to avoid unnecessary detail description from dimming the prevent invention.

The display driving method according to the present invention can be used for driving a display device, wherein the display device may include: a liquid crystal display or an organic light emitting diode (OLED) panel. Various embodiments of the present invention are described using LCD as example.

Figure 1:
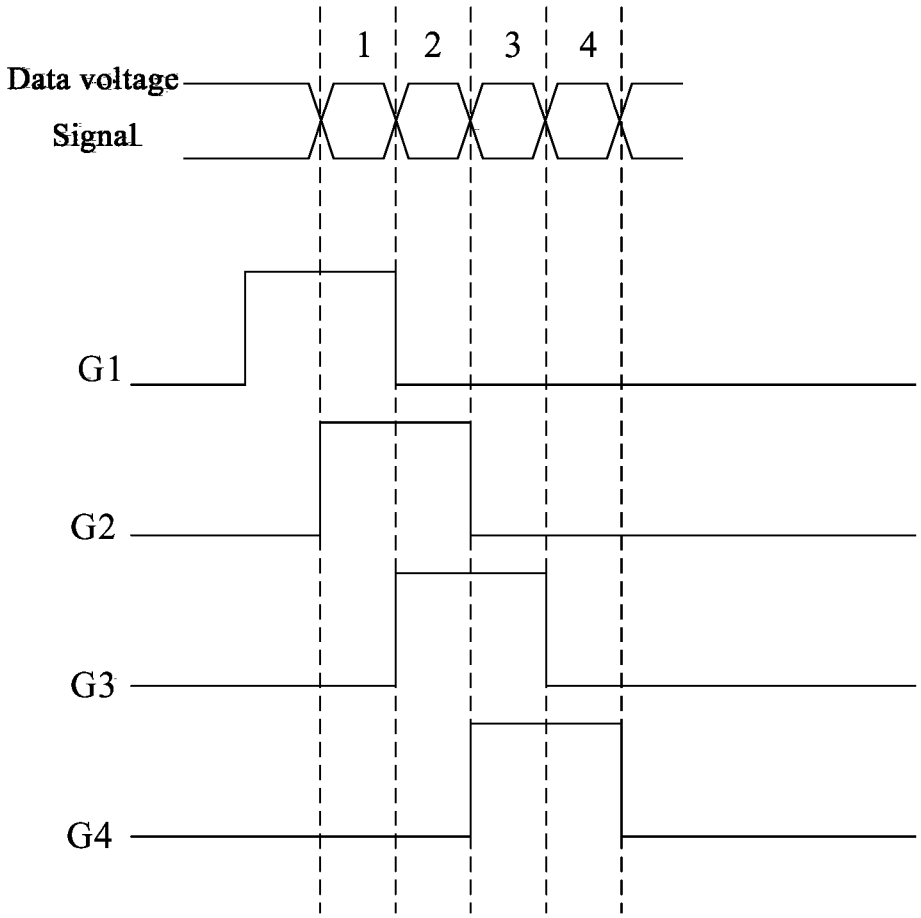
Fig. 1 (Prior Art)
FIG. 1 is a timing diagram of the driving method in the prior art.
Figure 2:
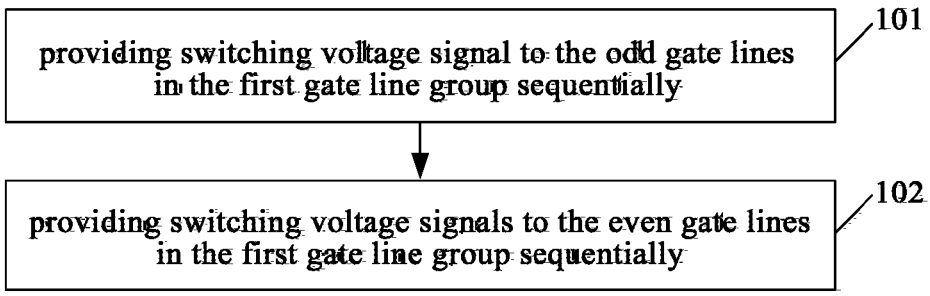
FIG. 2 is a schematic flow chart of the display driving method according to an embodiment of the present invention.

The present embodiment provides a display driving method using overlapping scan mode (i.e. the switching voltage signals are overlapped therebetween), every two adjacent rows of pixel units of the LCD have two gate lines, the two gate lines drive the pixel units connected thereto respectively, each gate line group includes N pairs of adjacent two gate lines, N being a natural number. In the present embodiment, two gate line groups comprising a first gate line group and a second gate line group are exemplified. As shown in FIG. 2, the method comprising:

Step 101, providing a switching voltage signal to the odd gate lines in the first gate line group sequentially.

Figure 3:
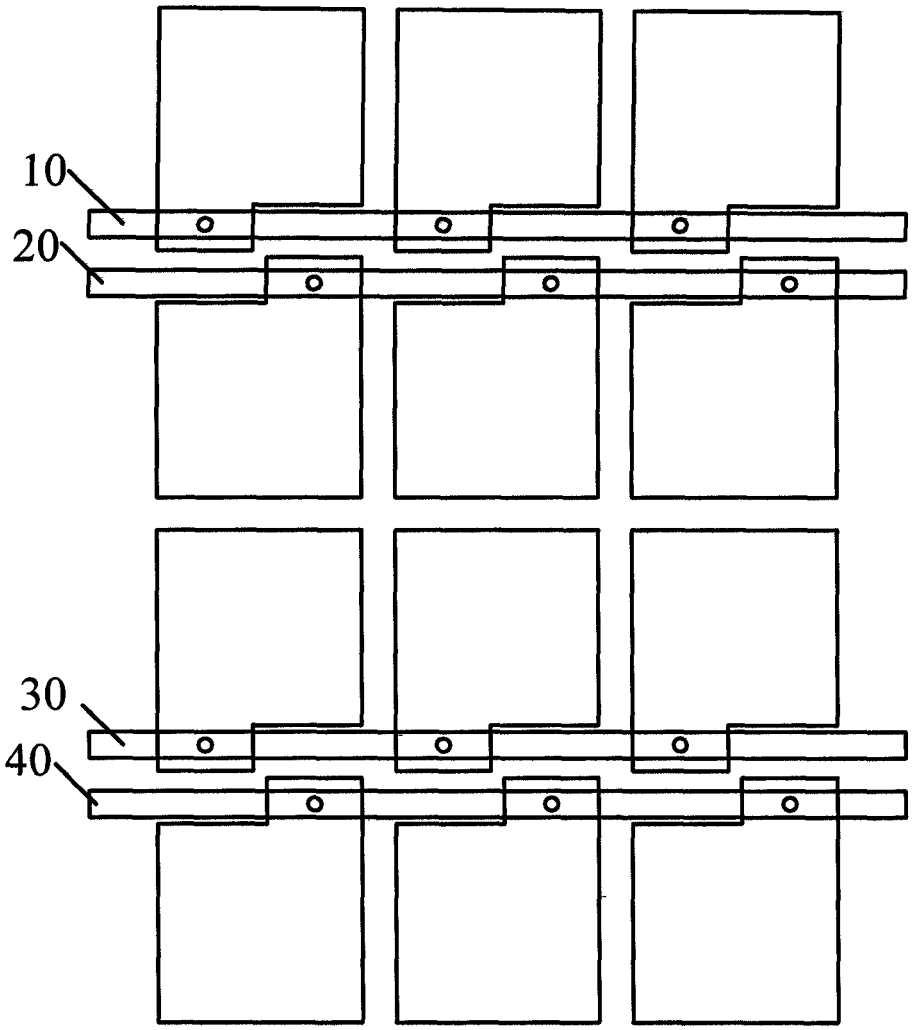
FIG. 3 is a schematic structural view of the array substrate according to an embodiment of the present invention.

In the LCD according to the present embodiment, every two rows of pixel units have two gate lines to control the two rows of pixel units respectively, the two gate lines drive the pixel units connected thereto respectively, each gate line group including N pairs of adjacent two gate lines, N being a natural number. Specifically, the structure of the array substrate of the present embodiment is shown in FIG. 3, the $2i-1^{th}$ and the $2i^{th}$ gate lines are located between two adjacent rows of pixel units, wherein i is a natural number, and two adjacent gate lines (one odd gate line and one even gate line) are located in the gaps between the two rows of pixel units; that is, the first gate line 10 and the second gate line 20 are both located between the first row of pixel units and the second row of pixel units; the third gate line 30 and the fourth gate line 40 are located between the third and the fourth rows of pixel units. In the present embodiment, the overlapped region of the switching voltage signals of two adjacent gate lines (one odd gate line and one even gate line) occupy a half of the switching voltage signal. For the switching voltage signals of the $2i-1^{th}$ and the $2i^{th}$ gate lines, when the switching voltage signal of one gate line is in rising edge, the switching voltage signal of the other gate line is in falling edge; that is, the switching voltage signal of one gate line of two adjacent gate lines in the same gap is in rising edge while the switching voltage signal of the other gate line is in falling edge. Due to the close proximity of the two gate lines, the magnetic field generated by the changing voltage on the two gate lines is canceled significantly.

In the present embodiment, all the gate lines are divided into several groups, each of the groups has at least four gate lines and the numbers of gate lines in each group are same. During display of the LCD, firstly the odd gate lines in the first gate line group are provided with switching voltage signals sequentially. Hereinafter, the driving method of the present step will be described in detail with for example, four gate lines in each gate line group.

Figure 4:
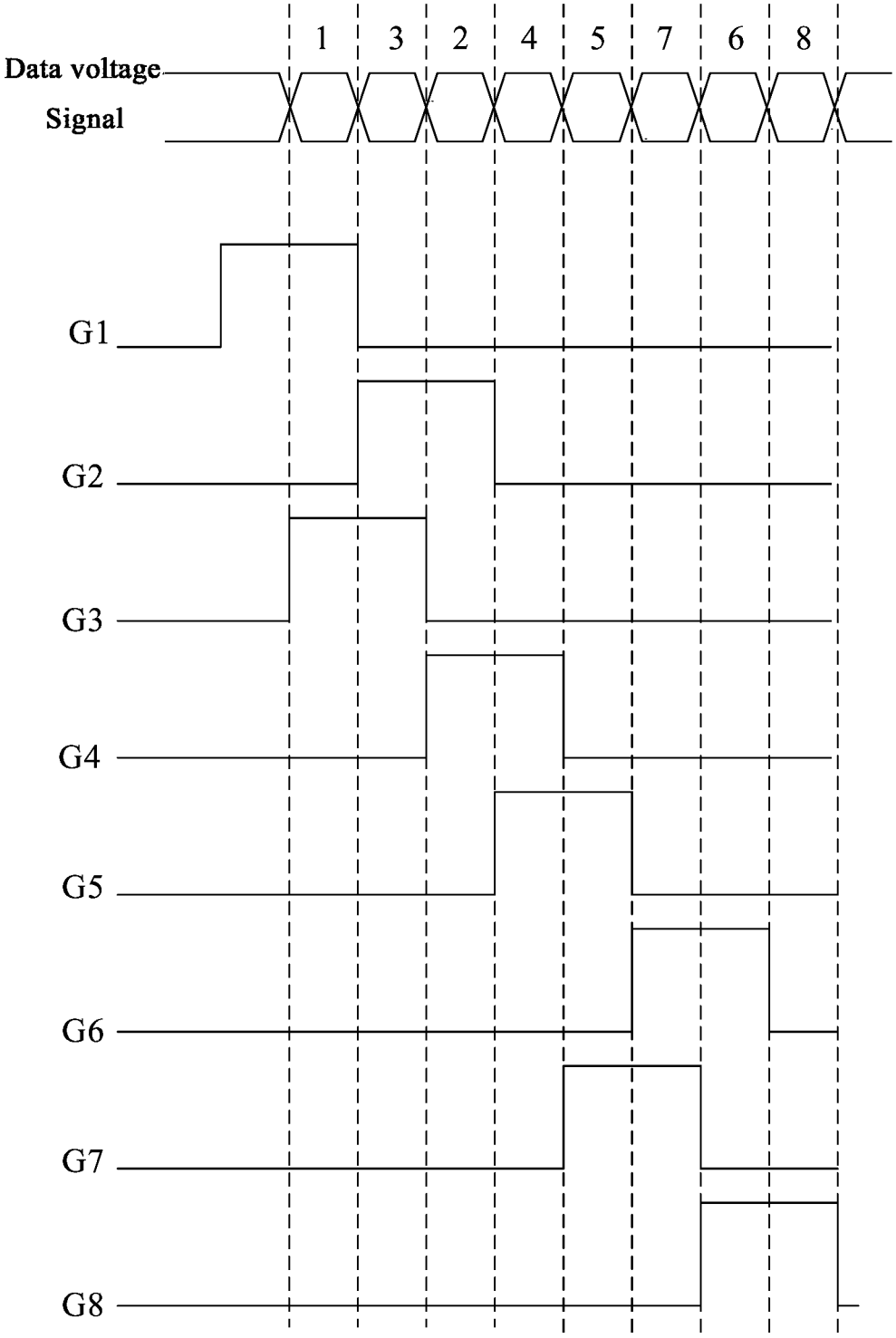
FIG. 4 is a timing chart of the driving method according to an embodiment of the present invention.

As shown in FIG. 4, the first gate line group comprises a first gate line G1, a second gate line G2, a third gate line G3 and a fourth gate line G4, each of the gate lines are provided with switching voltage signal.

Firstly, providing a switching voltage signal to the first gate line G1, and providing a data voltage signal to the corresponding first row of pixel units. Specifically, providing a first data voltage signal 1 to a corresponding first row of pixel units in the second half of the switching voltage signal.

Then, providing a switching voltage signal to the third gate line G3, and providing a data voltage signal to the corresponding third row of pixel units. Specifically, since the third gate line G3 is turned on when the data signal driving unit provides the first data voltage signal 1 to the first row of pixel units, thus the first data voltage signal 1 of the first row of pixel units is written to the corresponding third row of pixel units in the first half of the switching voltage signal, and the third data voltage signal 3 is written to the third row of pixel units in the second half of the switching voltage signal.

Besides, then the gate lines are grouped, six or eight gate lines can be divided into one group, other even number can be used as desired. The present invention is not limited hereto.

Step 102, providing switching voltage signals to the even gate lines in the first gate line group sequentially.

After providing switching voltage signals to the odd gate lines in the first gate line group sequentially is completed, the even gate lines in the first gate line group are provided with switching voltage signals sequentially.

Firstly, providing a switching voltage signal to the second gate line G2, and providing a data voltage signal to the second row of pixel units. Specifically, since the second gate line G2 is turned on when the data signal driving unit provides the third data voltage signal 3 to the third row of pixel units, thus the third data voltage signal 3 of the third row of pixel units is written to the corresponding second row of pixel units in the first half of the switching voltage signal, and the second data voltage signal 2 is written to the third row of pixel units in the second half of the switching voltage signal.

Then, providing a switching voltage signal to the fourth gate line G4, and providing a data voltage signal to the corresponding fourth row of pixel units. Specifically, since the fourth gate line G4 is turned on when the data signal driving unit provides the second data voltage signal 2 to the second row of pixel units, thus the second data voltage signal 2 of the second row of pixel units is written to the corresponding fourth row of pixel units in the first half of the switching voltage signal, and the fourth data voltage signal 4 is written to the fourth row of pixel units in the second half of the switching voltage signal.

As shown in FIG. 4, the switching voltage signals on the adjacent two gate lines in a same gap are set in a manner that the switching voltage signal of the first gate line G1 is in falling edge while that of the second gate line G2 is in rising edge, thus the magnetic field generated by voltage changes in the two gate lines are canceled by each other, the coupling effect is reduced, and the change of the voltage on the gate lines do not affect other metal lines such as common electrode line and data lines.

Figure 5:
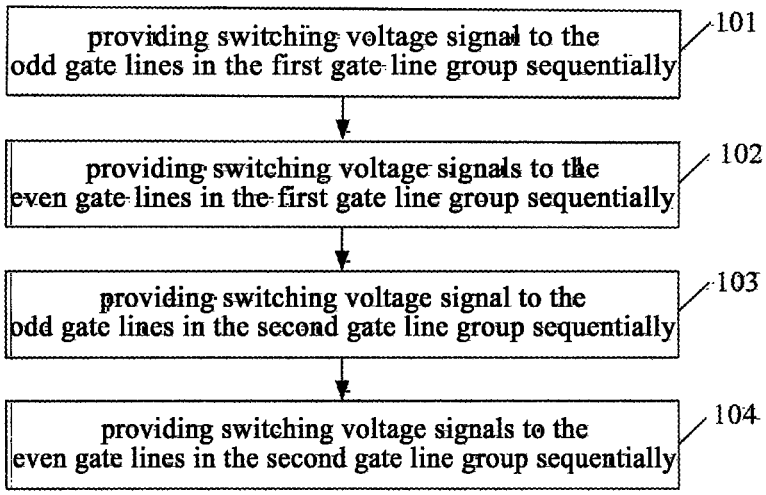
FIG. 5 is another schematic flow chart of the display driving method according to an embodiment of the present invention.

Further, as shown in FIG. 5, after driving of the first gate line group is completed, the second, third . . . gate line groups will be driven sequentially, until the gate lines of the whole screen are scanned. Specifically, after providing switching voltage signals to the even gate lines in the first gate line group sequentially, the method further comprises:

Step 103, providing a switching voltage signal to the odd gate lines in the second gate line group sequentially; and Step 104, providing switching voltage signals to the even gate lines in the second gate line group sequentially.

The second gate line group comprises a fifth gate line G5, a sixth gate line G6, a seventh gate line G7 and a eighth gate line G8, each of the gate lines are provided with switching voltage signal. The above mentioned steps specifically comprise:

Providing a switching voltage signal to the fifth gate line G5, and providing a data voltage signal to the fifth row of pixel units; specifically, the fourth data voltage signal 4 of G4 is written to the corresponding fifth row of pixel units in the first half of the switching voltage signal, and the fifth data voltage signal 5 is written to the fifth row of pixel units in the second half of the switching voltage signal;

Providing a switching voltage signal to the seventh gate line G7, and providing a data voltage signal to the seventh row of pixel units; specifically, the fifth data voltage signal 5 of G5 is written to the corresponding seventh row of pixel units in the first half of the switching voltage signal, and the seventh data voltage signal 7 is written to the seventh row of pixel units in the second half of the switching voltage signal;

Providing a switching voltage signal to the sixth gate line G6, and providing a data voltage signal to the sixth row of pixel units; specifically, the seventh data voltage signal 7 of G7 is written to the corresponding sixth row of pixel units in the first half of the switching voltage signal, and the sixth data voltage signal 6 is written to the sixth row of pixel units in the second half of the switching voltage signal;

Providing a switching voltage signal to the eighth gate line G8, and providing a data voltage signal to the eighth row of pixel units; specifically, the sixth data voltage signal 6 of G6 is written to the corresponding eighth row of pixel units in the first half of the switching voltage signal, and the eighth data voltage signal 8 is written to the eighth row of pixel units in the second half of the switching voltage signal.

Moreover, while providing a switching voltage signal to the odd gate lines in the gate line group sequentially, the method further comprises:

storing the switching voltage signal of the even gate lines in the RAM (random access memory) of the timing controller;

and before providing the switching voltage signals sequentially to the even gate lines in the gate line group, the method further comprising:

reading from the RAM of the timing controller the switching voltage signals of the even gate lines.

In the present embodiment, after providing the switching voltage signal to the first gate line, the third gate line rather than the second gate line is provided with switching voltage signal, therefore the switching voltage signal of the second gate line shall be stored temporarily. Specifically, according to the present embodiment, the switching voltage signals of the even gate lines are stored in the RAM of the timing controller, and when the switching voltage signals shall be provided to the even gate lines, the switching voltage signals of the even gate lines can be read from the RAM of the timing controller.

Figure 6:
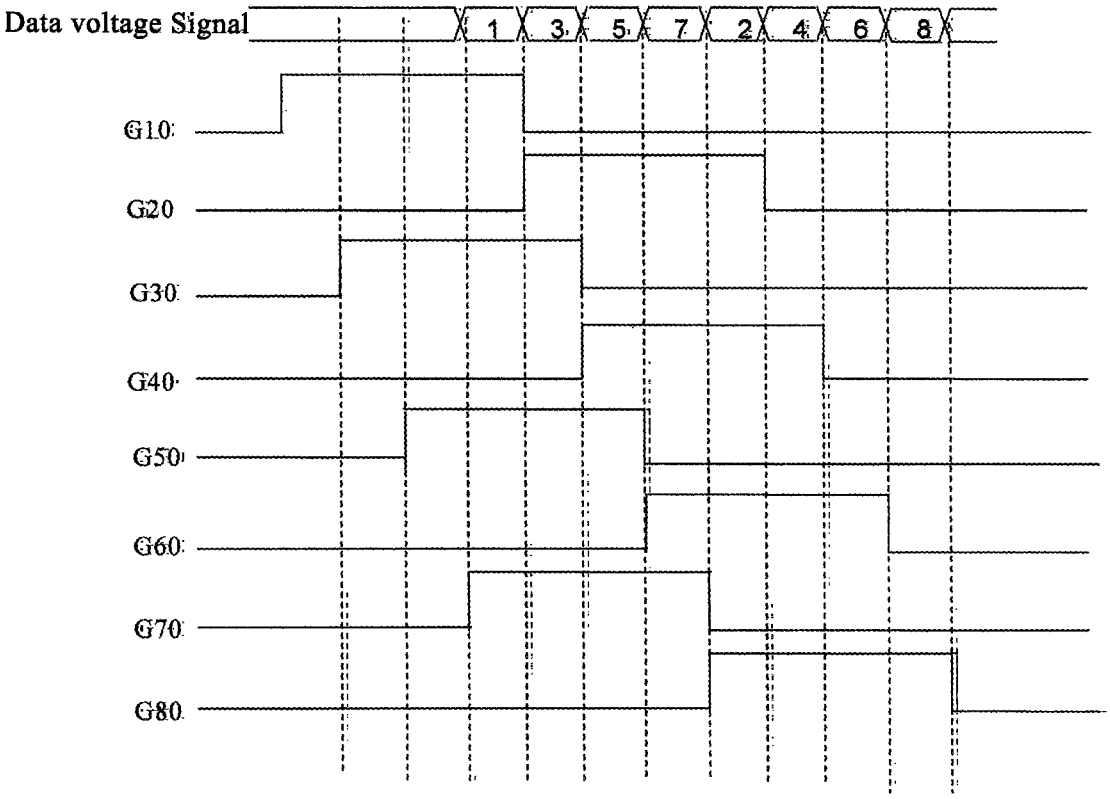
FIG. 6 is another timing chart of the driving method according to an embodiment of the present invention.
Figure 7:
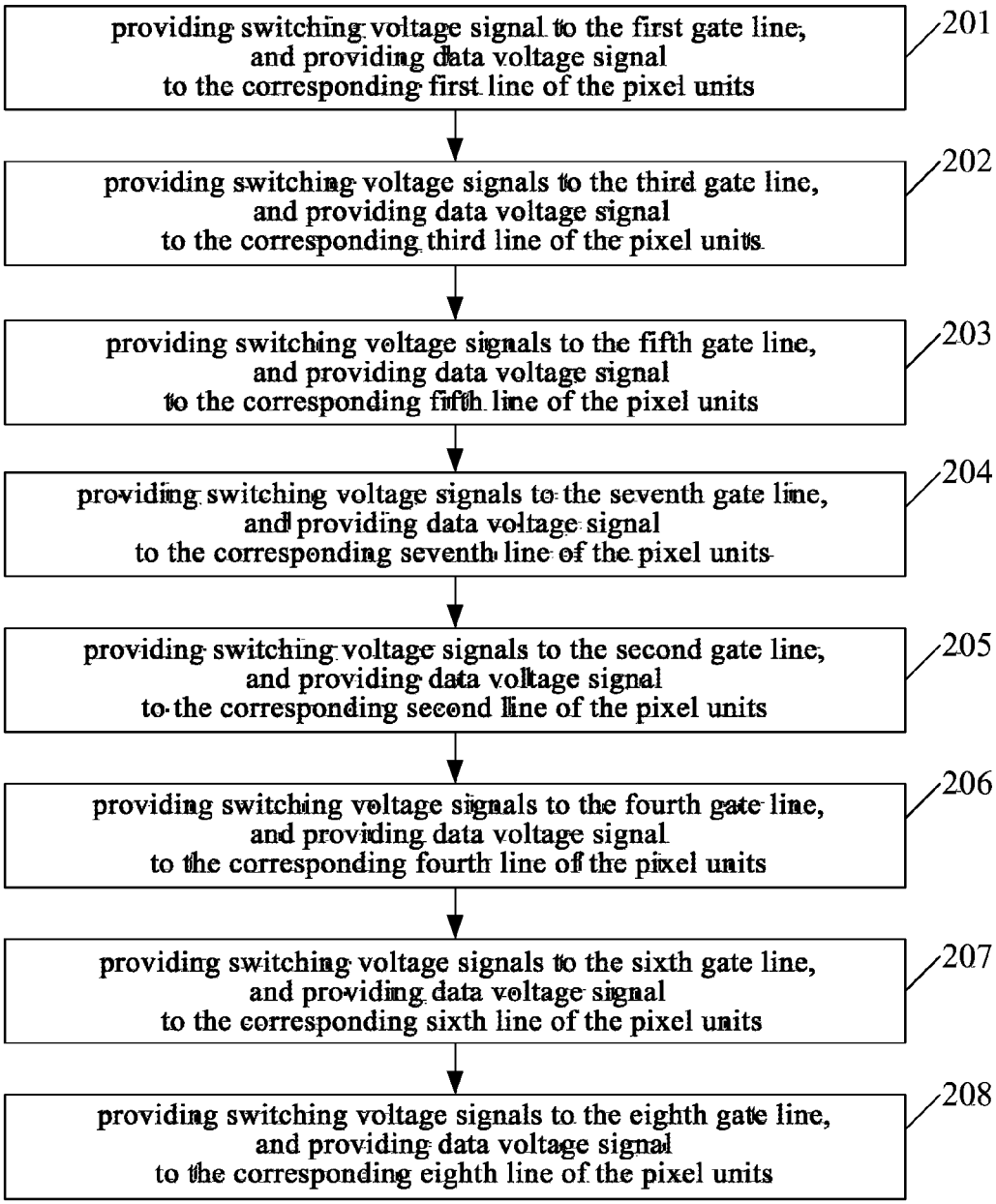
FIG. 7 is still another schematic flow chart of the display driving method according to an embodiment of the present invention.

As shown in FIGS. 6 and 7, when N=2 as a further embodiment of the present invention, each of the gate line group includes eight gate lines, i.e. a first gate line G10, a second gate line G20, a third gate line G30, a fourth gate line G40, a fifth gate line G50, a sixth gate line G60, a seventh gate line G70 and a eighth gate line G80. The differences from the above embodiment are that, according to the present embodiment, the overlapped region of the switching voltage signals of two adjacent odd gate lines in each gate line group occupies three quarter of the switching voltage signal, which means the number of gate lines in each gate line group is at least 8. It should be noted that, the sequence of the following steps are not precisely the practical sequence. As shown in FIG. 7, the driving method of the present invention comprises:

Step 201, providing a switching voltage signal to the first gate line, and providing a data voltage signal to the corresponding first row of pixel units;

specifically, firstly providing a switching voltage signal to the first gate line G10, and then providing a first data voltage signal 1 to a corresponding first row of pixel units in the last quarter of the switching voltage signal.

Step 202, providing switching voltage signals to the third gate line, and providing a data voltage signal to the corresponding third row of pixel units;

specifically, after providing switching voltage signals to the third gate line G30, the data signal driving unit is providing the first data voltage signal 1 in the third quarter of the switching voltage signal and the TFT is turned on in this period, therefore the data signal driving unit provides the first data voltage signal to a corresponding third row of pixel units in the third quarter of the switching voltage signal, and provides the third data voltage signal 3 in the last quarter of the switching voltage signal, thus providing the third data voltage signal 3 to the corresponding third row of pixel units in the last quarter of the switching voltage signal.

Step 203, providing switching voltage signals to the fifth gate line, and providing a data voltage signal to the corresponding fifth row of pixel units;

specifically, providing the first data voltage signal 1 to a corresponding fifth row of pixel units through the fifth gate line G50 in the second quarter of the switching voltage signal, providing the third data voltage signal 3 to the corresponding fifth row of pixel units in the third quarter of the switching voltage signal, and providing the fifth data voltage signal 5 to the corresponding fifth row of pixel units in the last quarter of the switching voltage signal.

Step 204, providing switching voltage signals to the seventh gate line, and providing a data voltage signal to the corresponding seventh row of pixel units;

specifically, providing the first data voltage signal 1 to a corresponding seventh row of pixel units through the seventh gate line G70 in the first quarter of the switching voltage signal, providing the third data voltage signal 3 to the corresponding seventh row of pixel units in the second quarter of the switching voltage signal, providing the fifth data voltage signal 5 to the corresponding seventh row of pixel units in the third quarter of the switching voltage signal, and providing the seventh data voltage signal 7 to the corresponding seventh row of pixel units in the last quarter of the switching voltage signal.

Step 205, providing switching voltage signals to the second gate line, and providing a data voltage signal to the corresponding second row of pixel units;

specifically, providing the third data voltage signal 3 to a corresponding second row of pixel units through the second gate line G20 in the first quarter of the switching voltage signal, providing the fifth data voltage signal 5 to the corresponding second row of pixel units in the second quarter of the switching voltage signal, providing the seventh data voltage signal 7 to the corresponding second row of pixel units in the third quarter of the switching voltage signal, and providing the second data voltage signal 2 to the corresponding second row of pixel units in the last quarter of the switching voltage signal.

Step 206, providing switching voltage signals to the fourth gate line, and providing a data voltage signal to the corresponding fourth row of pixel units;

specifically, providing the fifth data voltage signal 5 to a corresponding fourth row of pixel units through the fourth gate line G40 in the first quarter of the switching voltage signal, providing the seventh data voltage signal 7 to the corresponding fourth row of pixel units in the second quarter of the switching voltage signal, providing the second data voltage signal 2 to the corresponding fourth row of pixel units in the third quarter of the switching voltage signal, and providing the fourth data voltage signal 4 to a corresponding fourth row of pixel units in the last quarter of the switching voltage signal.

Step 207, providing switching voltage signals to the sixth gate line, and providing a data voltage signal to the corresponding sixth row of pixel units;

specifically, providing the seventh data voltage signal 7 to a corresponding sixth row of pixel units through the sixth gate line G60 in the first quarter of the switching voltage signal, providing the second data voltage signal 2 to a corresponding sixth row of pixel units in the second quarter of the switching voltage signal, providing the fourth data voltage signal 4 to a corresponding sixth row of pixel units in the third quarter of the switching voltage signal, and providing the sixth data voltage signal 6 to a corresponding sixth row of pixel units in the last quarter of the switching voltage signal.

Step 208, providing switching voltage signals to the eighth gate line, and providing a data voltage signal to the corresponding eighth row of pixel units;

specifically, providing the second data voltage signal 2 to a corresponding eighth row of pixel units through the eighth gate line G80 in the first quarter of the switching voltage signal, providing the fourth data voltage signal 4 to a corresponding eighth row of pixel units in the second quarter of the switching voltage signal, providing the sixth data voltage signal 6 to a corresponding eighth row of pixel units in the third quarter of the switching voltage signal, and providing the eighth data voltage signal 8 to a corresponding eighth row of pixel units in the last quarter of the switching voltage signal.

According to the display driving method of an embodiment of the present invention, all the gate lines are divided into several groups, when scanning the display, firstly the odd gate lines in the first gate line group are provided with switching voltage signals sequentially, then the even gate lines in the first gate line group are provided with switching voltage signals sequentially. In this way, the switching voltage signals on the adjacent two gate lines are set in a manner that one is in rising edge while the other is in falling edge, the magnetic field generated by voltage changes in the two adjacent gate lines are canceled by each other, such that the coupling effect is significantly reduce and the stability of display is improved.

The above are specific embodiments of the present invention, but the scope of the present invention is not limited thereto, variations or replacement in the technical scope of the present invention are apparent to any person skilled in the art, and should fall within the protective scope of the present invention. Accordingly, the protective scope of the invention should be defined by the appended claims.

What is claimed is:

1. A display driving method using an overlapping scan mode, wherein two gate lines are arranged between two rows of pixel units for driving the two rows of pixel units respectively, each of the two adjacent gate lines exclusively drives one of the two rows of pixel units, respectively, wherein every N pairs of the two adjacent gate lines comprises a gate line group, N being a natural number, the display driving method comprising:

providing a switching voltage signal to the odd gate lines in the gate line group sequentially; and providing a switching voltage signal to the even gate lines in the gate line group sequentially;

wherein for every two adjacent gate lines, when the switching voltage signal on the odd gate lines has a falling edge, the switching voltage signal on the even gate lines has a rising edge;

wherein N=2, and each gate line group includes four gate lines;

wherein the gate line group comprises a first gate line, a second gate line, a third gate line and a fourth gate line and wherein the display driving method further comprises:

providing a switching voltage signal to the first gate line, and providing a data voltage signal to the corresponding first row of the pixel units;

then providing a switching voltage signal to the third gate line, and providing a data voltage signal to the corresponding third row of the pixel units;

then providing a switching voltage signal to the second gate line, and providing a data voltage signal to the corresponding second row of the pixel units; and then providing a switching voltage signal to the fourth gate line, and providing a data voltage signal to the corresponding fourth row of the pixel units.

2. The display driving method of claim 1, wherein providing a data voltage signal to the corresponding first row of the pixel units comprises:

providing a first data voltage signal to the corresponding first row of the pixel units in the second half of the switching voltage signal;

providing a data voltage signal to the corresponding third row of the pixel units comprising: transmit the first data voltage signal of the first row of the pixel units to the corresponding third row of the pixel units in the first half of the switching voltage signal, and transmit a third data voltage signal to the corresponding third row of the pixel units in the second half of the switching voltage signal;

providing a data voltage signal to the second row of the pixel units comprising: transmit the third data voltage signal of the third row of the pixel units to the corresponding second row of the pixel units in the first half of the switching voltage signal, and transmit a second data voltage signal to the corresponding second row of the pixel units in the second half of the switching voltage signal;

providing a data voltage signal to the fourth row of the pixel units comprising: transmit the second data voltage signal of the first row of the pixel units to the corresponding fourth row of the pixel units in the first half of the switching voltage signal, and transmit a fourth data voltage signal to the corresponding fourth row of the pixel units in the second half of the switching voltage signal.

3. The display driving method of claim 1, wherein N=4, and each gate line group includes eight gate lines.

4. The display driving method of claim 3, wherein the gate line group comprises a first gate line, a second gate line, a third gate line, a fourth gate line, a fifth gate line, a sixth gate line, a seventh gate line and an eighth gate line and wherein the display driving method further comprises:

providing a switching voltage signal to the first gate line, and providing a data voltage signal to the corresponding first row of the pixel units;

then providing a switching voltage signal to the third gate line, and providing a data voltage signal to the corresponding third row of the pixel units;

then providing a switching voltage signal to the fifth gate line, and providing a data voltage signal to the corresponding fifth row of the pixel units;

then providing a switching voltage signal to the seventh gate line, and providing a data voltage signal to the corresponding seventh row of the pixel units;

then providing a switching voltage signal to the second gate line, and providing a data voltage signal to the corresponding second row of the pixel units;

then providing a switching voltage signal to the fourth gate line, and providing a data voltage signal to the corresponding fourth row of the pixel units;

then providing a switching voltage signal to the sixth gate line, and providing a data voltage signal to the corresponding sixth row of the pixel units; and then providing a switching voltage signal to the eighth gate line, and providing a data voltage signal to the corresponding eighth row of the pixel units.

5. The display driving method of claim 4, wherein providing a data voltage signal to the corresponding first row of the pixel units comprises:

providing a first data voltage signal to the corresponding first row of the pixel units in the last quarter of the switching voltage signal;

providing a data voltage signal to the corresponding third row of the pixel units comprising: providing the first data voltage signal to a corresponding third row of the pixel units in the third quarter of the switching voltage signal, and providing a third data voltage signal to the corresponding third row of the pixel units in the last quarter of the switching voltage signal;

providing a data voltage signal to the corresponding fifth row of the pixel units comprising: providing the first data voltage signal to a corresponding fifth row of the pixel units in the second quarter of the switching voltage signal, providing the third data voltage signal to the corresponding fifth row of the pixel units in the third quarter of the switching voltage signal, and providing a fifth data voltage signal to the corresponding fifth row of the pixel units in the last quarter of the switching voltage signal;

providing a data voltage signal to the corresponding seventh row of the pixel units comprising: providing the first data voltage signal to a corresponding seventh row of the pixel units in the first quarter of the switching voltage signal, providing the third data voltage signal to the corresponding seventh row of the pixel units in the second quarter of the switching voltage signal, providing the fifth data voltage signal to the corresponding seventh row of the pixel units in the third quarter of the switching voltage signal, and providing a seventh data voltage signal to the corresponding seventh row of the pixel units in the last quarter of the switching voltage signal;

providing a data voltage signal to the corresponding second row of the pixel units comprising: providing the third data voltage signal to a corresponding second row of the pixel units in the first quarter of the switching voltage signal, providing the fifth data voltage signal to the corresponding second row of the pixel units in the second quarter of the switching voltage signal, providing the seventh data voltage signal to the corresponding second row of the pixel units in the third quarter of the switching voltage signal, and providing a second data voltage signal to the corresponding second row of the pixel units in the last quarter of the switching voltage signal;

providing a data voltage signal to the corresponding fourth row of the pixel units comprising: providing the fifth data voltage signal to a corresponding fourth row of the pixel units in the first quarter of the switching voltage signal, providing the seventh data voltage signal to the corresponding fourth row of the pixel units in the second quarter of the switching voltage signal, providing the second data voltage signal to the corresponding fourth row of the pixel units in the third quarter of the switching voltage signal, and providing a fourth data voltage signal to the corresponding fourth row of the pixel units in the last quarter of the switching voltage signal;

providing a data voltage signal to the corresponding sixth row of the pixel units comprising: providing the seventh data voltage signal to a corresponding sixth row of the pixel units in the first quarter of the switching voltage signal, providing the second data voltage signal to the corresponding sixth row of the pixel units in the second quarter of the switching voltage signal, providing the fourth data voltage signal to the corresponding sixth row of the pixel units in the third quarter of the switching voltage signal, and providing a sixth data voltage signal to the corresponding sixth row of the pixel units in the last quarter of the switching voltage signal; and providing a data voltage signal to the corresponding eighth row of the pixel units comprising: providing the second data voltage signal to a corresponding eighth row of the pixel units in the first quarter of the switching voltage signal, providing the fourth data voltage signal to the corresponding eighth row of the pixel units in the second quarter of the switching voltage signal, providing the sixth data voltage signal to the corresponding eighth row of the pixel units in the third quarter of the switching voltage signal, and providing a eighth data voltage signal to the corresponding eighth row of the pixel units in the last quarter of the switching voltage signal.

6. The display driving method of claim 1, wherein, when providing a switching voltage signal to the odd gate lines in the gate line group sequentially, the display driving method further comprises storing the switching voltage signal of the even gate lines into a random access memory of a timing controller; and wherein, before providing a switching voltage signal to the even gate lines in the gate line group sequentially, the display driving method further comprises reading from the random access memory of the timing controller the switching voltage signal of the even gate lines.

* * * * *